US007116795B2

(12) United States Patent
Tuason et al.

(10) Patent No.: US 7,116,795 B2
(45) Date of Patent: Oct. 3, 2006

(54) SELF-ALIGNING SELF-SEALING HIGH-FIDELITY PORTABLE SPEAKER AND SYSTEM

(76) Inventors: Michael P Tuason, 4011 Sadie Ct., Campbell, CA (US) 95008; Robert D. Zucker, 950 N. San Antonio Rd., Apt. #9B, Los Altos, CA (US) 94022

( * ) Notice: Subject to any disclaimer, the term of this patent is extended or adjusted under 35 U.S.C. 154(b) by 408 days.

(21) Appl. No.: 10/772,495

(22) Filed: Feb. 5, 2004

(65) Prior Publication Data

US 2004/0156523 A1 Aug. 12, 2004

Related U.S. Application Data

(60) Provisional application No. 60/446,042, filed on Feb. 6, 2003.

(51) Int. Cl.
*H04R 25/00* (2006.01)

(52) U.S. Cl. ..... 381/386; 381/338; 381/345

(58) Field of Classification Search ..... 381/87, 381/189, 300, 301, 303–306, 335, 338, 345, 381/349, 351, 353, 354, 386, 387; 181/145, 181/153, 156, 178, 196–199
See application file for complete search history.

(56) References Cited

U.S. PATENT DOCUMENTS

| | | | | |
|---|---|---|---|---|
| 3,866,712 | A | 2/1975 | Carruthers | |
| 4,042,778 | A | 8/1977 | Clinton | |
| 4,356,882 | A | 11/1982 | Allen | |
| 4,501,934 | A * | 2/1985 | Wiener | 381/387 |
| 4,591,020 | A * | 5/1986 | Hruby, Jr. | 181/145 |
| 5,103,927 | A | 4/1992 | Heavener | |
| 5,450,495 | A | 9/1995 | Goldfarb | |
| 5,550,926 | A * | 8/1996 | Tsao | 381/386 |
| 5,664,020 | A | 9/1997 | Goldfarb et al. | |
| 5,933,507 | A | 8/1999 | Woolley et al. | |
| 5,979,591 | A | 11/1999 | Harrison | |
| 6,031,925 | A | 2/2000 | Shteyn | |
| 6,176,346 | B1 | 1/2001 | Wiener | |
| 6,292,358 | B1 | 9/2001 | Lee et al. | |
| 6,292,573 | B1 | 9/2001 | Zurek et al. | |
| 6,367,579 | B1 | 4/2002 | Wiener | |
| D498,471 | S | 11/2004 | Solland et al. | |
| 6,813,362 | B1 | 11/2004 | Bank et al. | |
| 2002/0159610 | A1 | 10/2002 | Bank et al. | |

FOREIGN PATENT DOCUMENTS

| | | |
|---|---|---|
| GB | 2 382 256 A | 5/2003 |

* cited by examiner

*Primary Examiner*—Huyen Le
(74) *Attorney, Agent, or Firm*—Fountainhead Law Group, PC; Chad R. Walsh

(57) ABSTRACT

In one embodiment, the present invention provides a portable speaker including a speaker driver, a first cylindrical ring coupled to the speaker driver, a base plate configured in parallel with the speaker driver, a second cylindrical ring affixed to the base plate, and one or more interposed unaffixed cylindrical rings, wherein in a first expanded state the sidewalls of adjacent rings form frictional seals and a substantially airtight rigid chamber having a height substantially equal to the sum of the sidewall heights of the cylindrical rings, and in an unexpanded state the sidewalls of the cylindrical rings are substantially parallel to one another. Embodiments of the present invention may be used in an audio system including a class-D amplifier.

20 Claims, 12 Drawing Sheets

SELF-ALIGNING SELF-SEALING HIGH-FIDELITY PORTABLE SPEAKER AND SYSTEM

BACKGROUND

This invention relates to speakers, and more particularly, to high fidelity portable speakers.

Speakers are devices that translate electronic signals into sound. While a variety of speakers have been around for a long time, recent developments in the portability of music in digital form have caused an increase in the demand for systems that can reproduce the music with high-fidelity (i.e., without distortion or noise). In particular, there is an increasing demand for speakers and systems that can be used with portable music players such as MP3 players or iPods.

However, there are a number of key limitations to contemporary portable speakers and systems. In the speaker industry, there is a well-known tradeoff between speaker size and frequency response. In practice the reduction of the enclosure volume of a speaker results in a corresponding reduction in its low frequency response and efficiency, regardless of the bass reinforcement methodology employed (ports, passive radiators, band-pass). The smallest of portable speakers have very poor low frequency content in their sound and often have audibly high harmonic distortion and cabinet buzzing. Larger portable speakers in a carrying bag may be portable but they are large. The best solution for high quality sound is to use a larger cabinet. However, as the cabinet size is increased, the speakers become less portable.

What is needed is a speaker system that has the acoustic advantages of a large cabinet based system, yet is very small in size so that it is highly portable. The present invention optimizes both of these features. The following detailed description and accompanying drawings provide a better understanding of the nature and advantages of the present invention.

SUMMARY

In one embodiment, the present invention provides a portable speaker including a speaker driver, a first cylindrical ring coupled to the speaker driver, a base plate configured in parallel with the speaker driver, a second cylindrical ring affixed to the base plate, and one or more interposed unaffixed cylindrical rings, wherein in a first expanded state the sidewalls of adjacent rings form frictional seals and a substantially airtight rigid chamber having a height substantially equal to the sum of the sidewall heights of the cylindrical rings, and in an unexpanded state the sidewalls of the cylindrical rings are substantially parallel to one another. Embodiments of the present invention may be used in an audio system including a class-D amplifier.

In one embodiment, the top of the first cylindrical ring is coupled to the speaker driver by a flange. The top of the ring is affixed to the flange, and the flange is connected to the speaker driver.

The portable speaker unit may include a lid having at least one arc for receiving the speaker unit and directing sound. In one embodiment, the lid includes two arcs for receiving the speaker unit horizontally and directing sound. In another embodiment, the lid may be attached to the speaker unit by a hinge. In another embodiment, the base plate includes at least one flat portion.

In another embodiment, the portable speaker unit includes a damping pad attached to the base plate to receive the speaker driver when the portable speaker unit is in an unexpanded state.

In yet another embodiment, base plate includes a filter. The filter may be a passive radiator or a tuned port that allows bass energy to escape the enclosure.

DETAILED DESCRIPTION

Embodiments of the present invention provide maximum speaker sound quality while simultaneously providing maximum portability. This is achieved by creating a maximum enclosed air volume when in an expanded state (e.g., while playing) and allowing for minimum external dimensions in an unexpanded state (e.g., while being transported or stored). A larger speaker enclosure increases the acoustical compliance of the enclosed volume of air, lowering the composite resonant frequency of the speaker system and resulting in considerable improvement of the bass response of the speaker system.

Embodiments of the present invention improve portability and fidelity by providing a compact transportation size that is primarily determined by the dimensions of the speaker driver. The assembly can be expanded several fold in size to form an airtight rigid enclosure in a simple and quick process. The enclosure can be manufactured such that the moderate expansion force causes the enclosure elements to form the airtight seal required for high fidelity full-range audio. The size of the enclosure is scalable to accommodate a wide range of applications from pocket-sized speaker systems to moderately compact full-range speakers to larger subwoofers. Embodiments of the present invention allow most speaker drivers to be placed in an enclosure size that is optimized for bass extension while playing, but when transportation is required, the large enclosure (i.e., the cabinet) can be reduced down to dimensions only slightly larger than the loudspeaker driver.

Figure 1:
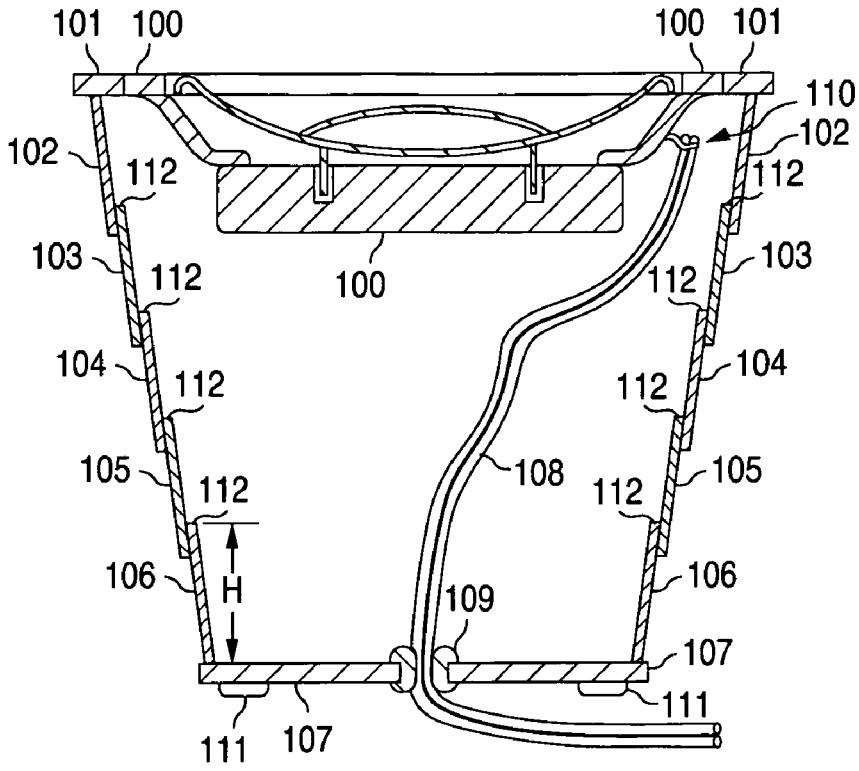
FIG. 1 illustrates a portable speaker in an expanded state according to one embodiment of the present invention.

Embodiments of the present invention can be configured into two different states: an expanded state, which is to be used for playing audio, and an unexpanded state, which is to be used for storage or transport. FIG. 1 illustrates a portable speaker according to one embodiment of the present invention. FIG. 1 shows a side view in cross-section of a portable speaker in its fully expanded state. The portable speaker includes a chamber formed by a speaker driver 100, one or more interlocking cylindrical rings (e.g., cylindrical rings 102, 103, 104, 105 and 106), and a base plate 107. Speaker driver 100 may be a compact shielded rare-earth speaker driver, for example. Speaker driver 100 is coupled to a top of affixed cylindrical ring 102, and base plate 107 is affixed to a bottom of cylindrical ring 106. However, one or more interposed rings (e.g., rings 103–105) may be unaffixed to adjacent rings. In one embodiment, these one or more rings are connected to the top and bottom rings by a frictional seal in the expanded state. Cylindrical rings 102–106 are expanded to form rigid sidewall of a cylindrical sealed chamber. In one embodiment, each cylindrical ring has substantially the same height, H. In an expanded state the sidewalls of adjacent rings form frictional seals 112, and the speaker driver 100, the base plate 107, and one or more interposed unaffixed cylindrical rings form a substantially airtight rigid chamber having a height, H, multiplied by the total number of cylindrical rings (i.e., the sum of top ring, the bottom ring and all intermediate rings). Embodiments of the present invention also contemplate a chamber having sidewalls comprised only of top ring 102 and bottom ring 106.

Figure 2:
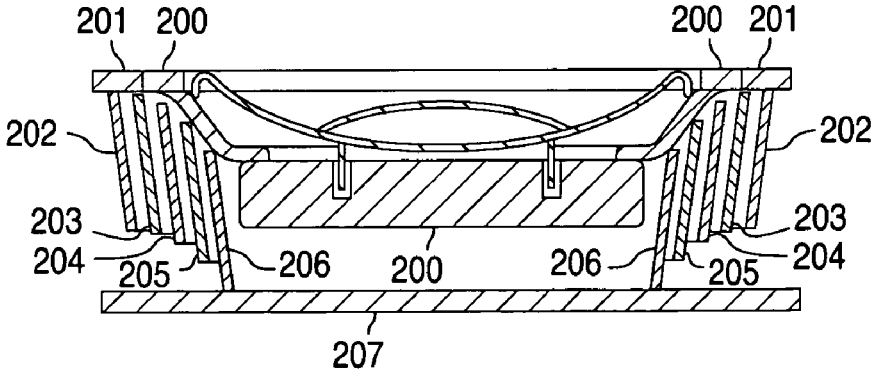
FIG. 2 illustrates a portable speaker in an unexpanded state according to one embodiment of the present invention.

FIG. 2 illustrates a portable speaker in an unexpanded state according to one embodiment of the present invention. FIG. 2 shows a side view in cross-section of the same basic version of the portable speaker shown in FIG. 1. In an unexpanded state the cylindrical rings are substantially parallel to one another and the height of the unexpanded speaker unit is limited by the height, H, of each ring (i.e., the height of the top ring, the bottom ring, or the one or more intermediate rings). The speaker is shown in a compact form, which is convenient for storage and transport. In the unexpanded state, the cylindrical rings 202, 203, 204, 205 and 206 are not frictionally connected together, but instead are loosely and concentrically nested together. The intermediate cylindrical rings 205, 204 and 203 are loose but wrap concentrically around the cylindrical ring 206. In an unexpanded state, they are contained on the bottom by the base plate 207 and cylindrical ring 206, and on the top by speaker 200, flange 201 and the top cylindrical ring 202. It is to be understood that all of the rings need not be exactly the same height. In fact, manufacturing tolerances may result in small deviations between the exact heights of each ring.

Referring again to FIG. 1, cylindrical rings 102–106 form substantially airtight rigid sidewalls of the chamber when expanded. These rings may be made from any combination of metal, wood, plastic, or any other substantially rigid airtight material (i.e., sufficiently rigid and airtight so that the desired acoustic fidelity is achieved). It is to be understood that the exact materials and dimensions will be dictated by design choice. In the present embodiment, each cylindrical ring may be configured to have a slight degree of taper. The taper of rings may be advantageously optimized to allow a modest pulling force to expand and friction-lock the rings to each other, forming a rigid chamber with an airtight seal. In an expanded state, the tapered cylindrical rings are joined together by friction seals 112 between each ring to form the sidewalls of an acoustic chamber. In particular, cylindrical ring 102 connects to an adjacent cylindrical ring 103 for form an airtight frictional seal 112. The cylindrical ring 103 connects to a cylindrical ring 104 via an airtight friction seal 112. The cylindrical ring 104 connects to a cylindrical ring 105 via an airtight friction seal 112. Likewise, the cylindrical ring 105 connects to another bottom cylindrical ring 106 via an airtight friction seal 112. The cylindrical rings 103, 104 and 105 are unaffixed to adjacent rings, whereas the bottom cylindrical ring 106 is affixed to base plate 107 and the top cylindrical ring 102 is affixed to speaker driver 100 either directly or indirectly through an intervening structure such as connector 101, which may be a flange as described below. Cylindrical rings 102 and 106 should be affixed such that the interfaces are airtight. These rings may be glued, welded, or molded as one piece, for example.

Embodiments of the present invention have several significant advantages that combine to achieve both improved portability and acoustic high fidelity. The cylindrical rings, when unexpanded, conform very closely to the shape of a typical compact speaker driver. This allows for the smallest possible compacted dimensions for a given footprint as shown in FIG. 2. By adjusting the characteristics of the cylindrical rings (e.g., rings 202, 203, 204, 205, and 206), the gap between the base plate 207 and the speaker driver 200 can be narrowed or eliminated minimizing the external volume of the speaker unit in its unexpanded state. For example, the height of bottom ring 206 may be reduced to compensate for the speaker and reduce the height of the unit in its unexpanded states. Alternatively, the radius could be increased, as in FIG. 3C below.

Cylindrical rings may also be very thin, and because they are stored concentrically, additional rings may be added to increase the volume of the chamber while contributing negligibly to the overall volume in the unexpanded state. However, in the expanded state, each additional ring would add considerably to the overall speaker volume in its expanded state. Thus, cylindrical rings are very effective at providing a large expansion and compression ratio (i.e., the ratio between the volumes of the expanded state and the unexpanded state). The result is a significant performance improvement as a loudspeaker, combined with a very small transportation volume. Further, embodiments of the present invention may have an arbitrary number of cylindrical rings, increasing the expanded state considerably further. If the speaker driver cannot be positioned parallel to the base plate in the unexpanded state, space will be wasted and the portable speaker unit will be larger than necessary.

Furthermore, the cylindrical rings are self-sealing, simple, and easy to manufacture and assemble, since no complex seals or attachments are required. In the unexpanded state, the rings are freely floating concentrically, unable to damage each other, and not subject to any concentrated mechanical stresses. During expansion, the rings are self-aligning, forming a simple friction seal, eliminating any need for o-rings, detents, seal materials, gears, slots, grooves, or other mechanisms which are vulnerable to wear and damage, and which increase manufacturing costs through materials and assembly time. The simple friction seal effectively constructs a closed chamber (one-piece cabinet), which is not subject to spurious resonances, rattles, or air leaks.

The circular profile of the cylindrical rings produces the optimal friction seal through its self-aligning nature. In particular, any local stress around each ring will cause minute flexing of each ring to match the shape of the others. These self-aligning properties of the tapered cylindrical rings produce a uniform seal because the sealing pressure is uniformly distributed around the ring. Circular rings are preferred in order to maintain even pressure points around the seal. Additionally, the most common form of speaker driver is circular and the use of cylindrical rings will provide for maximum compaction in the unexpanded state.

The use of cylindrical rings that have a slight taper also provides for better acoustic properties. An acoustic damping pad may be included on the base plate (see below) to increase audible fidelity by absorbing much of the higher frequency sound waves that would otherwise be reflected internally by the base plate and impact onto the speaker diaphragm in the driver. This unwanted reflection causes distortion in the acoustic waves emanating from the driver. An acoustic damping pad can also be designed to contact the speaker driver during transport in the unexpanded (compacted) state to provide helpful shock absorption and to prevent rattling and potential damage to the speaker.

Returning to FIG. 1, speaker driver 100 may be coupled to the top cylindrical ring 102 indirectly through an intervening structure such as top flange 101. Speaker driver 100 may be attached to flange 101, for example, via screws or adhesive cement using a rubber gasket or similar material to maintain an airtight seal between the top flange and the speaker driver. The purpose of the top flange is to provide a mounting interface for the loudspeaker driver to be affixed to the top of the top cylindrical ring. This top flange 101 can be fabricated metal, plastic, wood, or other rigid airtight material and is affixed to cylindrical ring 102, for example, by welding or glue. In another embodiment, the speaker may be affixed to a single assembly including the flange and top cylindrical ring. Base plate 107 may be a circular disc of uniform cross-section and is made from metal, wood plastic or some other rigid airtight material. The purpose of the base plate is to provide an airtight seal at the end of the bottom cylindrical ring. In another embodiment, the base plate and bottom cylindrical ring may be a single assembly. The base plate also serves to provide bottom containment for the intermediate cylindrical rings when the speaker is in the unexpanded state. The base plate may include a round hole with a sealing grommet 109 through which protrudes a speaker wire 108. The sealing grommet may be affixed using adhesive cement or via pressure fit such that it is airtight. Within the speaker chamber, the speaker wire is attached to an electrical terminal 110 via an electronic solder weld.

When fully expanded, all of the elements in FIG. 1 together define an airtight speaker chamber resembling that of an approximate cylinder. If the rings are tapered, the chamber will have a slight corresponding taper. According to one use, the expanded speaker may be placed on a hard surface such as a table or desk for the playing of music or any desired audio content. To prevent the speaker from coupling undesired vibrations to its supporting hard surface, several rubber pads 111 may be placed beneath the base plate. The rubber pads provide for mechanical isolation between the speaker and its resting surface.

Figure 3A:
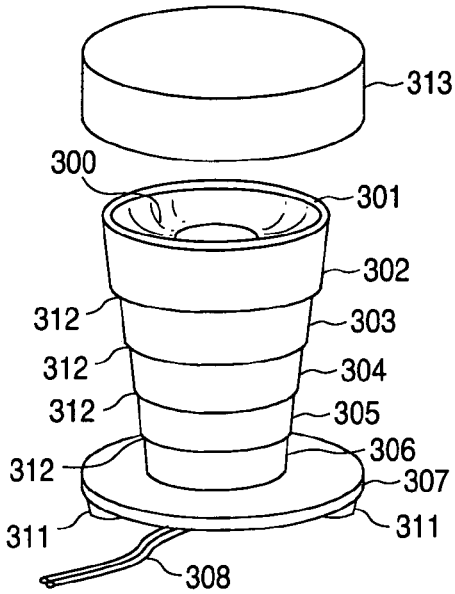
FIGS. 3A–C illustrates a complete portable speaker unit including a protective lid that covers the top of the speaker and the sides during transportation according to one embodiment of the invention.
Figure 3B:
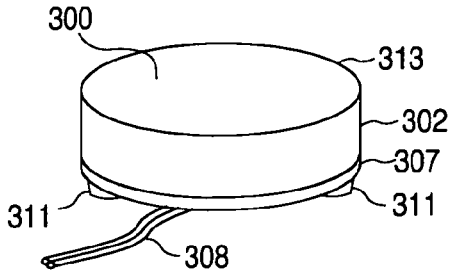
Figure 3C:
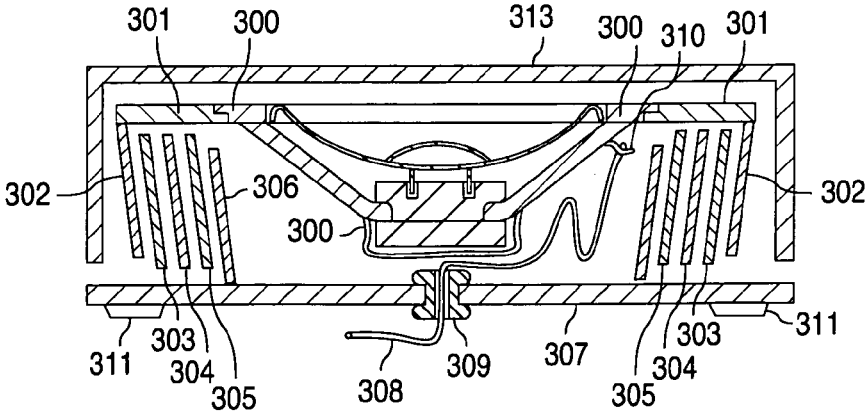

FIGS. 3A–C illustrate a complete portable speaker unit including a protective lid that covers the top of the speaker and the sides during transportation according to one embodiment of the invention. In FIGS. 3A–C, a protective lid 313 is added to the portable speaker unit. FIGS. 3A–C show three views of this embodiment. FIG. 3A shows a front perspective view of the fully expanded state of the portable speaker with lid 313. Protective lid 313 may be placed over the speaker and in contact with the base plate to completely enclose the speaker and sides during transport. FIG. 3B shows a front perspective view of the same embodiment in its unextended state with its lid attached. FIG. 3C shows a side view in cross-section of the present embodiment in its unexpanded portable state with the lid 313 attached. To reconfigure the speaker from its fully expanded state FIG. 3A to its unexpanded state FIG. 3B, enough pressure is applied to the top flange and top cylindrical ring to break the frictional seals between the cylindrical rings. As can be seen from FIG. 3C, the dimensions of a portable speaker may be reduced almost all the way down to the dimension of the speaker driver itself. However, in an expanded state, the speaker chamber will be approximately N times the height of the sidewalls of the cylindrical rings, where N is the number of rings used.

Figure 4A:
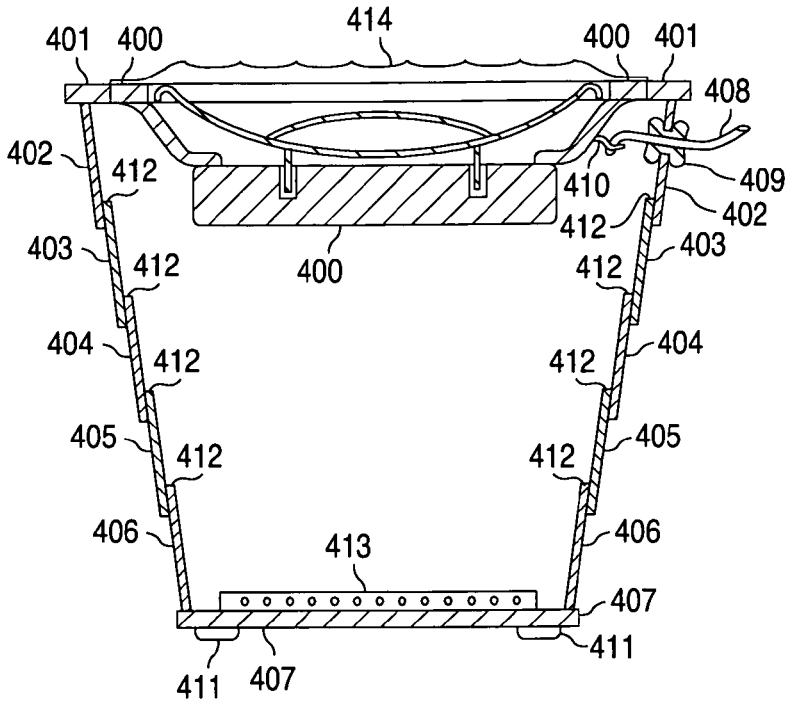
FIGS. 4A–B illustrate a portable speaker having a speaker wire exit in a top cylindrical ring and a speaker grill according to other embodiments of the invention.
Figure 4B:
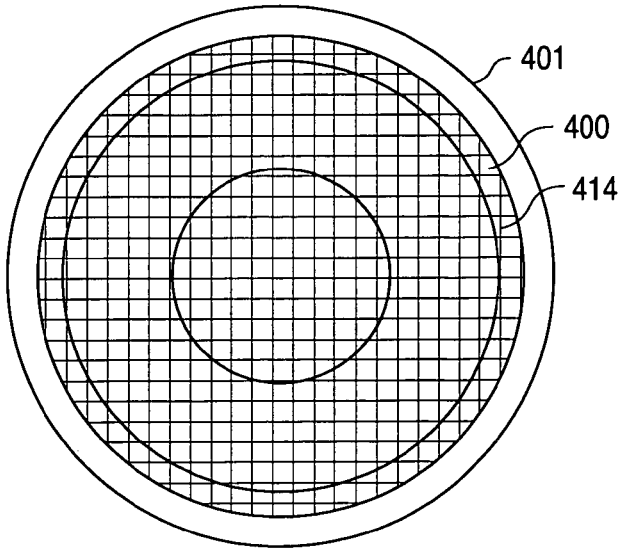

FIGS. 4A–B illustrate a portable speaker having a speaker wire exit in a top cylindrical ring and a speaker grill according other embodiments of the present invention. One conceivable problem with embodiments described herein is that cylindrical rings may be twisted when the portable speaker is either in the expanded state, unexpanded state, or in between states. FIG. 4A illustrates an embodiment configured such that a speaker wire is not vulnerable to twisting during expansion and contraction. The first modification is to bring the speaker wire out of the cabinet through either the top flange 401 (not shown) or the top cylindrical ring 402 (as shown in FIG. 4). This prevents any twisting of the rings from twisting or shearing the speaker wires. As shown in FIG. 4A, speaker wire 408 may exit the chamber through a hole in the top tapered cylindrical ring 402. With this improvement, cylinders are free to rotate without damaging the speaker wire.

FIG. 4A also illustrates an embodiment the uses a damping pad 413. An acoustic damping pad may be included on base plate 407 to increase audible fidelity by absorbing much of the higher frequency sound waves that would otherwise be reflected internally by the base plate and impact onto the speaker diaphragm in the driver. This unwanted reflection causes distortion in the acoustic waves emanating from the driver. Acoustic damping pad 413 also contacts the speaker driver during transport in the unexpanded (compacted) state to provide helpful shock absorption and preventing rattling and potential damage to the speaker.

FIG. 4B illustrates another feature that may be used in embodiments of the present invention. A speaker grill composed of a wire mesh 414 or perforated rigid sheet is placed over the speaker driver 400 and attached to the top flange 401 to protect the speaker from damage. The embodiment of FIG. 4 illustrates both important enhancements, which address the hazards of repeated expansion/contraction cycles. These enhancements improve use and reliability of the present invention.

Figure 5A:
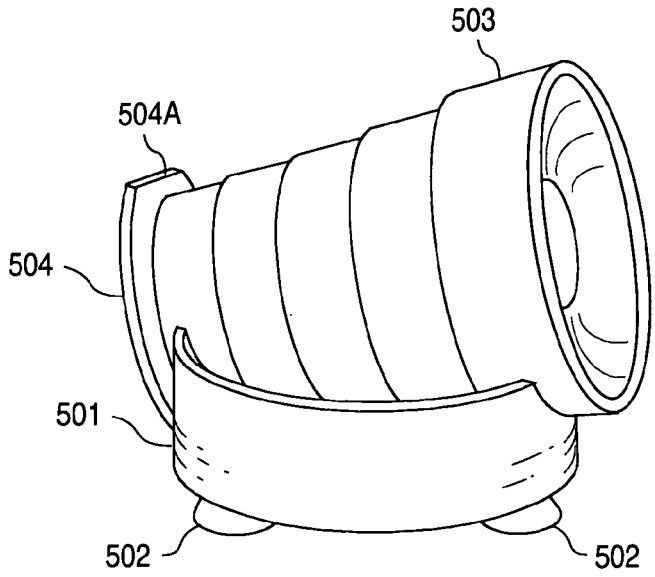
FIGS. 5A–E illustrates another portable speaker unit and a protective lid for controlling the direction of the sound according to another embodiment of the invention.
Figure 5B:
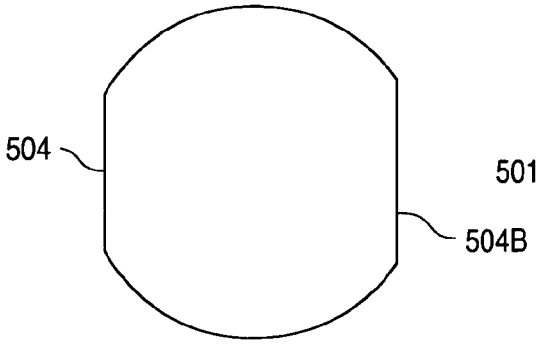
Figure 5C:
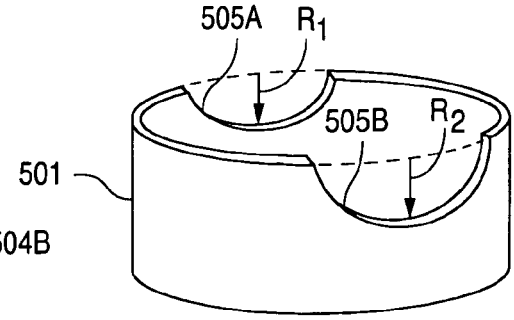

FIGS. 5A–E illustrates another portable speaker unit including a protective lid for controlling the direction of the sound according to another embodiment of the invention. FIG. 5 is an enhancement that details how the protective lid 501 can serve a second function as a stand to direct the speaker toward the listener's ears. The storage lid 501 provides a supportive stand as shown in FIG. 5A that allows the speaker to be freely adjusted both vertically and horizontally to change the direction of the sound (e.g., to point the sound toward the listener or to tune the "sweet spot"). As shown in FIG. 5B, base plate 504 includes flat portions 504A and 504B. These flat portions may be made, for example, by cutting across a chord of the circular base plate 504. Two flat portions created by cutting across different chords may be provided. Additionally, as shown in FIG. 5C, lid 501 has been modified by cutting out notches or arcs 505A and 505B from its side walls such that it can be used direct the speaker across a range of horizontal angles, rather than standing the speaker on its base plate. The radius, R1, of arc 505A may be, but not necessarily need be, smaller than the radius, R2, of arc 505B. Different arcs may be used to enhance upward direction of the speaker. In one embodiment, the notches may be covered with rubber to prevent unwanted vibrations. Additionally, several rubber pads 502 may be attached to the lid allowing the portable speaker unit to rest securely on a playing surface without unwanted vibrations. The speaker lid can be shaped such that wires can easily be wound around the closed assembly during transport.

Figure 5D:
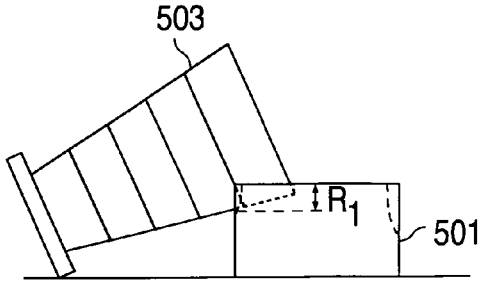
Figure 5E:
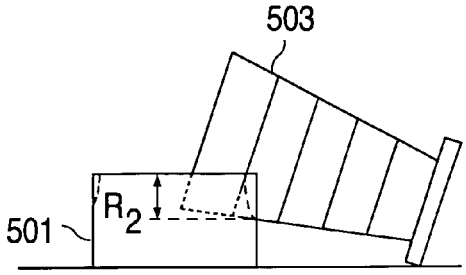

Using the lid arcs and base plate flat portions, lid 501 of the portable speaker unit may be used to direct the sound towards a listener or listeners. For example, the entire speaker may be placed horizontally in both arcs (FIG. 5A) and rotated to adjust the direction of the sound. FIGS. 5D–E show alternative configurations. In FIG. 5D, the speaker may be rested on the smaller lid arc 505A. Further vertical adjustment is made by selecting between either of the flat portions 504A or 504B. Similarly, the speaker may be rested on the larger lid arc 505B as shown in FIG. 5E to vary the speaker vertically across a shallower range of angles.

Figure 6A:
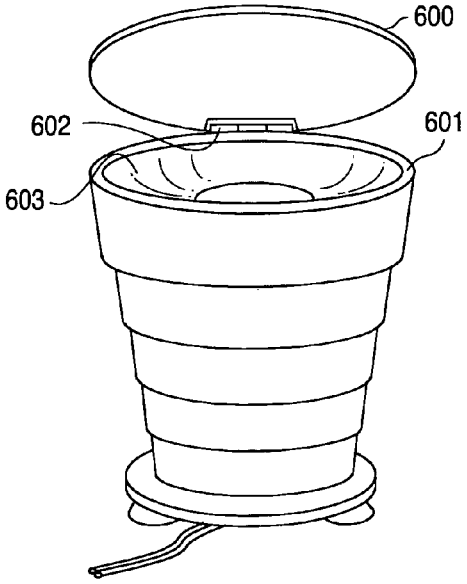
FIGS. 6A–B illustrates another portable speaker and hinged lid according to another embodiment of the present invention.
Figure 6B:
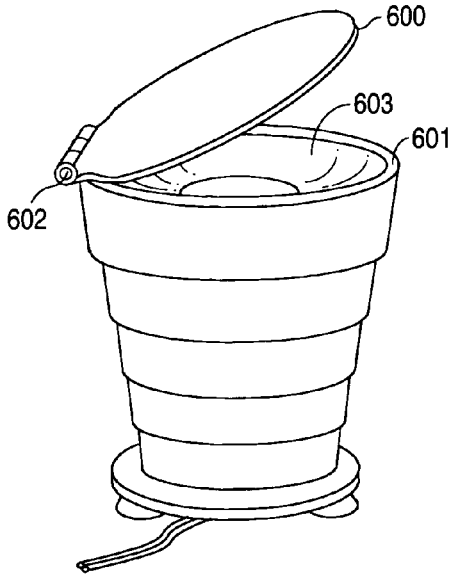

FIGS. 6A–B illustrates another portable speaker and hinged lid according to another embodiment of the present invention. A portable speaker includes a flat disc-shaped lid 600 that is connected to the top assembly 601 (e.g., a flange) via a hinge 602. Unlike FIG. 5, in which the lid 501 is used as a stand, here the lid 600 is hinged and remains attached to the speaker cabinet. The speaker may be played while facing vertically since lid 600 is angled to bounce the sound toward the listener's ears. This is very similar to the function of a piano lid. For example, the hinged lid may have two basic positions. When open as shown in FIGS. 6A and 6B it may be set to an approximately 45 degree angle. In this open position the lid reflects the sound from the speaker driver and directs it towards the audience. When the lid is in the closed, or down position, it serves to protect the speaker driver from damage during transport or non-use.

Figure 7A:
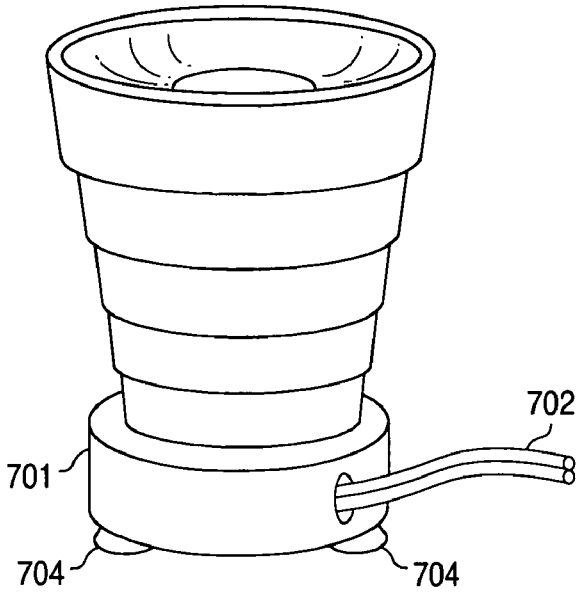
FIGS. 7A–B illustrates another portable speaker including a base plate with retractable cord assembly according to yet another embodiment of the present invention.
Figure 7B:
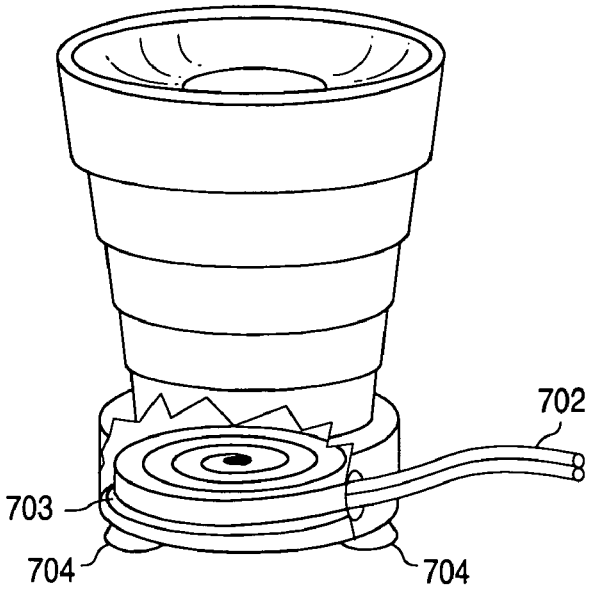

FIGS. 7A–B illustrates another portable speaker including a base plate with retractable cord assembly according to yet another embodiment of the present invention. The base plate 701 includes a housing with a retractable cord spooling assembly 703 that allows the speaker cord 702 to be automatically retracted during transport.

Figure 8A:
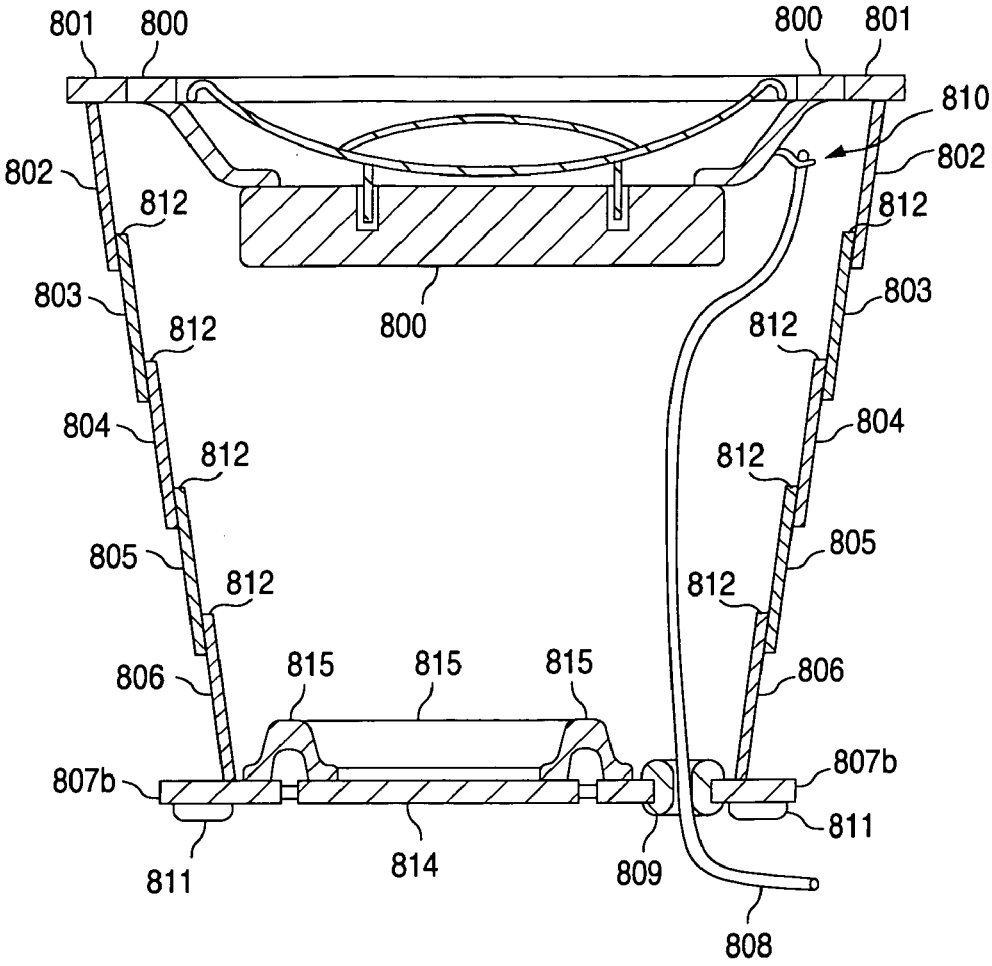
FIG. 8A illustrates another portable speaker including a passive radiator according to another embodiment of the present invention.

FIG. 8A illustrates another portable speaker including a filter comprised of a passive radiator according to another embodiment of the present invention. FIG. 8A shows an embodiment of a portable speaker that involves cabinet tuning, which allows bass energy is allowed to escape the enclosure. Speaker driver 800 provides the acoustic energy. Base plate 807*b* has been modified to include a passive radiator. A passive radiator is a sealed vibrating panel, which is tuned to vibrate in sympathy with the driver at low frequencies, thereby extending the bass response. It may be connected to the base plate by an elastic suspension 815, for example. Passive radiator 815 is used to improve the low frequency or bass response of the portable speaker. A tuned passive radiator is essentially a suspended panel, which vibrates in response to the sound waves inside the sealed enclosure such that it reinforces the sound waves produced by speaker driver 800. In another embodiment, a tuned band-pass enclosure may be provided, wherein speaker 800 is mounted internally to one of the intermediate rings, thus forming two sealed sub-chambers. The top sub-chamber is completely sealed while the bottom sub-chamber has a passive radiator affixed to the base plate as in FIG. 8B. The band-pass enclosure allows for even more extended low frequency response as might be required for implementation of compact subwoofers.

Figure 8B:
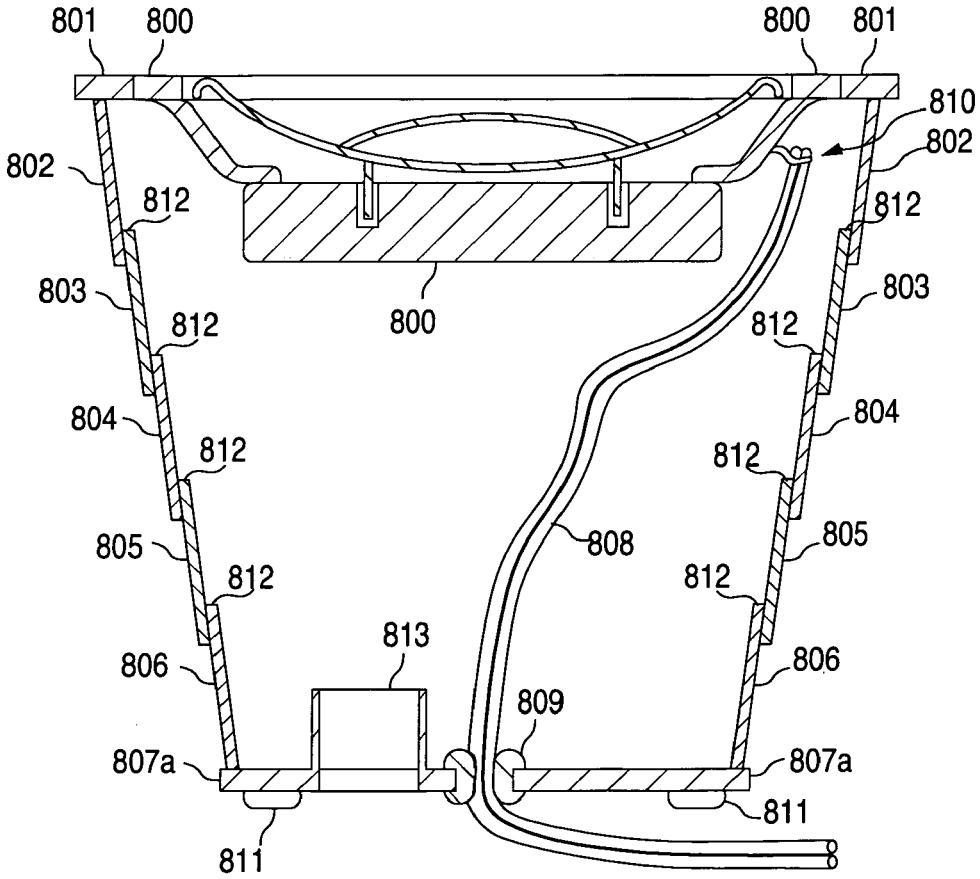
FIG. 8B illustrates another portable speaker including a tuned bass reflex port according to another embodiment of the present invention.

FIG. 8B illustrates another portable speaker including a filter comprised of a tuned port according to another embodiment of the present invention. FIG. 8B shows an embodiment of a portable speaker that involves cabinet tuning that allows bass energy to escape the enclosure. A tuned port 813 is added to the base 807*a*. This allows the low frequency response of the cabinet to be extended by a careful release of energy from inside the enclosure through the port 813. A tuned port is a controlled opening in the speaker chamber that allows for sound waves to escape the speaker chamber such that it reinforces the output from the main speaker driver. Though this tuned port is an opening in the sealed chamber or enclosure, it should be noted here that the remainder of the chamber, particularly the friction seals 112, remain airtight so as to prevent distortion caused by uncontrolled sound waves from escaping the chamber.

Figure 9A:
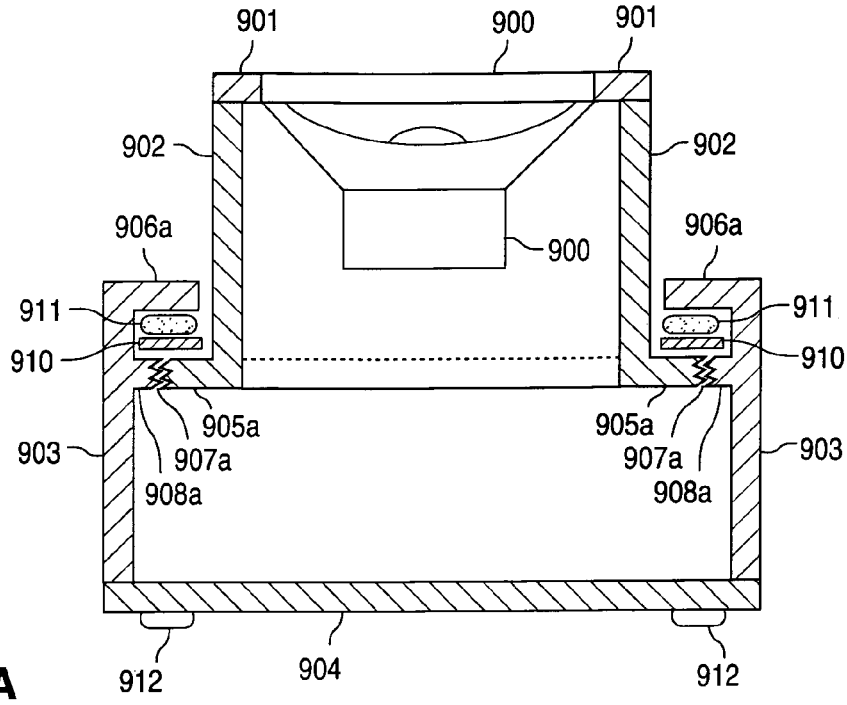
FIG. 9 illustrates another embodiment of the present invention.

FIG. 9 shows a two section enclosure in which the top section if composed of a speaker driver 900 attached to a top flange 901, which is fused to a top cylindrical ring 902. This assembly interfaces through a pair of screw threads 907*a* to a bottom assembly, which is composed of a sidewall 903, a bottom plate 904, which has rubber feet 912. To expand the enclosure, the top assembly is lifted until it contacts the screw threads, which are used to compress the O-ring 911 between a containment flange 906*a* and a sliding washer 910. Any number of sections may be employed.

Figure 9B:
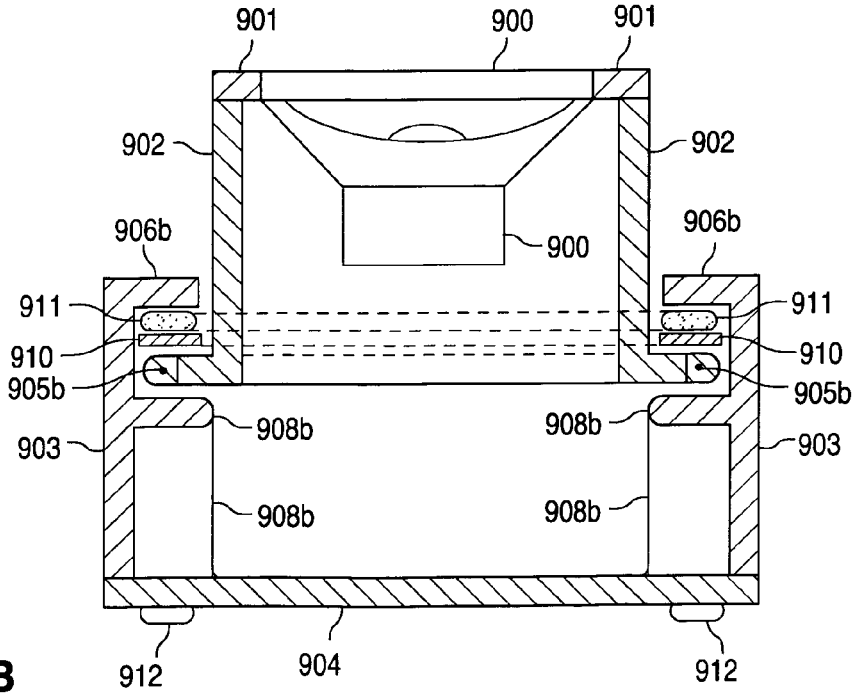
Figure 9C:
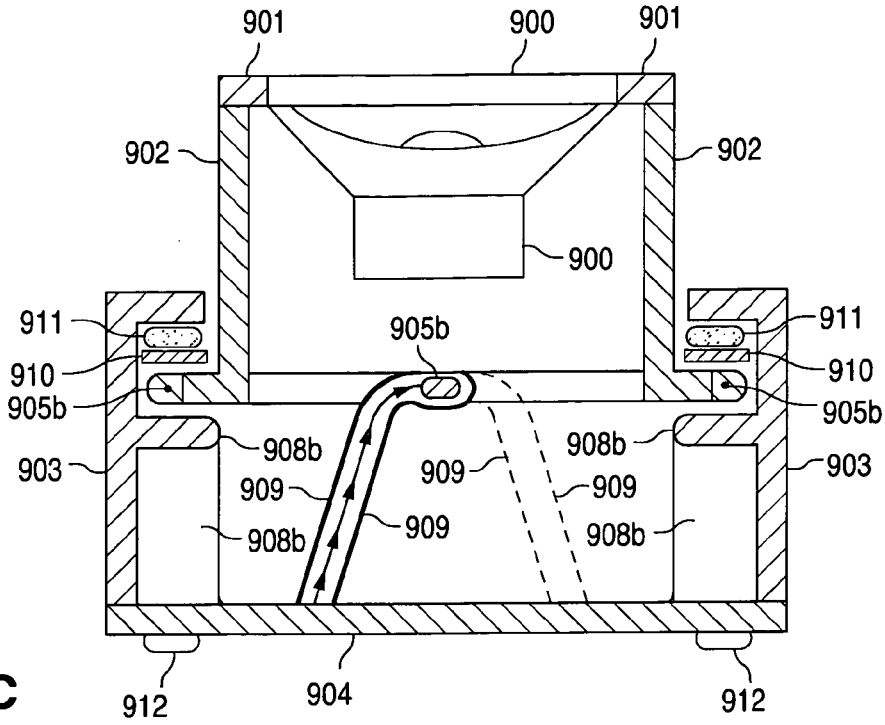

FIG. 9*b* shows an alternative to the embodiment of FIG. 901 in which the screw mount thread has been replaced by a bayonet mount, which is essentially a variable pitch screw thread composed of a cam 908*b*, which guides a pin 905*b*, forcing the enclosure to expand while its two sections are rotated against each other. The dark outline 909 in FIG. 9*c* shows the cam 908*b* from a side view. The pin 905*b* is shown in the open and locked position. The dotted line 909 shows another cam located 180 degrees around the enclosure from that represented by the dark line 909. Any number of cams 909 paired with pins 905*b* may be used. FIG. 9*b* represents an enclosure with two pairs of cams 909 and pins 905*b*. FIG. 9*c* indicates the positions of four pairs of cams 909, 908*b*, and pins 905*b*. The preferred embodiment contains three pairs of cams 909, 908*b*, and pins 905*b*.

Figure 10A:
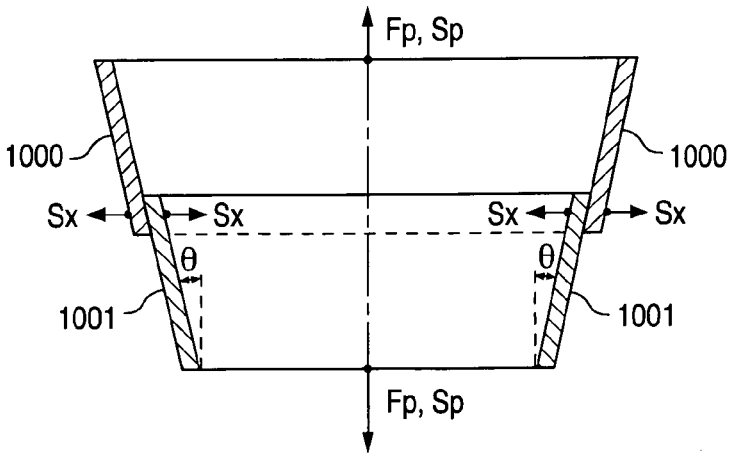
FIGS. 10A–C illustrates the force vector diagrams that define a self-sealing friction seal according to embodiments of the present invention.
Figure 10B:
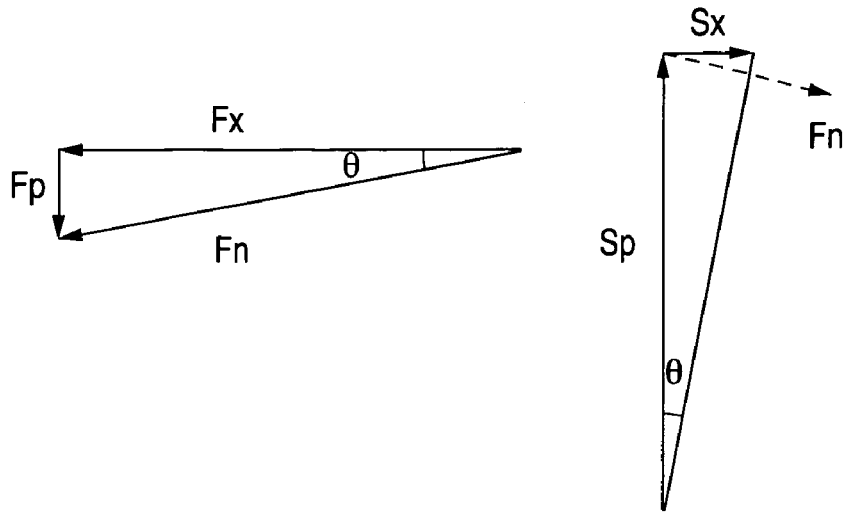
Figure 10C:
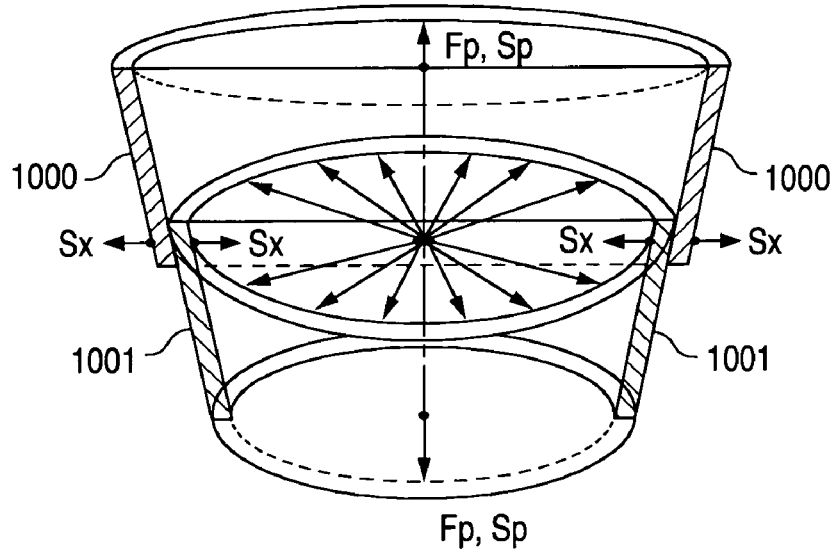

FIGS. 10A–C illustrates the force vector diagrams that define a self-sealing friction seal according to embodiments of the present invention. FIG. 10A shows a cross-sectional view of two cylindrical rings being forced against each other when the portable speaker is being reconfigured into a fully expanded state. This diagram illustrates the physics behind the operation of the friction seal. The pulling forces that pry open the enclosure are in equilibrium equal and opposite; they are labeled as Fp. The small distance that the colliding rings are sliding past each other along the pulling axis is $S_P$. For this to occur, the inner ring must be compressed in its radius and the outer ring must be stretched in its radius. This radial action creates a spring that acts perpendicularly to the pulling force. FIG. 10B shows the force and displacement diagrams of the two surfaces between the rings as they compress against each other. The applied force stores energy in the spring, which is applied according to the mechanical advantage defined by the wedge angle theta, θ. Angle theta is defined by how far from the vertical axis the sidewalls of the rings are tilted. The stored energy is given by the work function along the pulling axis:

$$Wp=Fp*S_P \quad \text{EQ1}$$

Where Work=force*distance and Wp is the work of the pulling force Fp through a distance $S_P$. By conservation of energy, the work is stored in the radial spring, and the radial work equation is:

$$Wr=Fr*S_R \quad \text{EQ2}$$

Where Wr is the work of the spring force Fr through the stretching distance $S_R$. Again, conservation of energy allow us to equate equations 1&2 as follows:

$$Fp*S_P=Fr*S_R \quad \text{EQ3}$$

FIG. 10C shows the triangular relationships of the force vectors for axial vs. radial displacements during the sealing process. By trigonometry:

$$S_R=S_P*\tan(\theta) \quad \text{EQ4}$$

For the small angles of theta this indicates that the radial displacement $S_R$ will be very small compared to the axial displacement $S_P$. With this in mind, we substitute EQ4 into EQ3 to get $$Fp*S_P=Fr\ \tan(\theta) \quad \text{EQ5}$$

Simplify EQ5 and solve for Fr as a function of Fp:

$$Fr=Fp/[\tan(\theta)] \quad \text{EQ6}$$

The tan(θ) is very small for small angles and so Fr is many times large than Fp the pulling force. To find the normal force Fn, FIG. 10C shows by trigonometry that $$Fn=Fr*\cos(\theta) \quad \text{EQ7}$$

Since cos(θ) is nearly unity for small angles of theta, $$\text{Fn=Fr} \quad \text{EQ8}$$

Substitute EQ8 into EQ6 and solving for the normal force Fn $$Fn=Fp/\tan(\theta) \quad \text{EQ9}$$

For a flexible ring, the force Fn is distributed evenly around the ring so we can simplify this description by lumping the normal forces to a single point and solve for the force, which defines the friction seal Fs. The lateral force of static friction is given by the applied normal force multiplied by the coefficient of friction.

$$F\text{static}=\mu*F\text{normal} \quad \text{EQ10}$$

Were μ is the coefficient of static friction. Applying EQ1- to EQ9, we get the sealing force, Fs.

$$Fs=\mu*(Fp/\tan(\theta)) \quad \text{EQ11}$$

What this indicates pertaining to this invention is the following. The more slippery (smaller μ) the material is, the smaller the angle θ must be to form a seal. Very small angles of θ will seal the chamber more effectively because this will cause the springs of the inner and outer rings to compress/expand bay a larger amount. Too small an angle θ will cause the springs to reach their elastic limit and tear or fracture the rings. If the rings are made from too flexible a material, they can be forced to "pop" past each other, again causing breakage of the invention. Thus, the choice of material, thickness and angle of taper, θ, all must be empirically optimized to strike a balance between reliability and the effectiveness of the friction seal.

Figure 11:
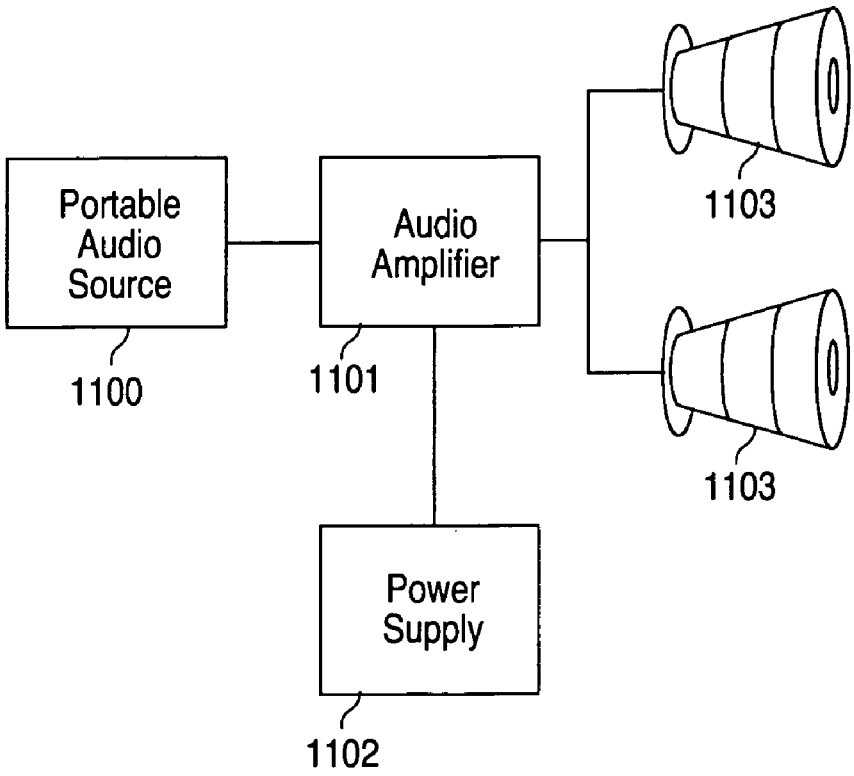
FIG. 11 illustrates a block diagram of system including embodiments of the present invention.

FIG. 11 illustrates a block diagram of a system including embodiments of the present invention. A portable amplified stereo speaker system includes two portable speakers 1103 used in conjunction with a portable audio amplifier 1101, portable power supply 1102, and a portable audio source 1100. In this example, the portable audio amplifier uses the portable power supply to amplify the signal from the portable audio source. The amplifier drives the pair of speakers. Options for the power supply include batteries (rechargeable or disposable), AC adapter or DC adapter (e.g., an automotive adapter). Examples of a portable audio source include a portable CD player, DVD player, Mini-Disc Player, iPod or other hard-disk based audio or video player, Rio MP3 player or other solid state memory-based audio or video player, laptop or desktop computer, movie or presentation projector, video game device, portable TV, video camera, or equivalent source. The audio amplifier 1101 is a compact electronic audio amplifier. In one embodiment, the portable audio amplifier may be of a class-D based topology. The class-D output stage provides for a higher efficiency of power transfer resulting in a longer battery life and smaller overall size than the typical class-AB topology and is thus more suitable for a portable system application.

Having fully described alternative embodiments of the present invention, other equivalent or alternative techniques will be apparent to those skilled in the art. These equivalents and alternatives along with the understood obvious changes and modifications are intended to be included within the scope of the present invention as defined by the following claims.

What is claimed is:

1. A portable speaker unit comprising:

a speaker driver;

a first affixed cylindrical ring, the first cylindrical ring having a top and a sidewall, the top being coupled to the speaker driver;

a base plate configured in parallel with the speaker driver;

a second cylindrical ring, the second cylindrical ring having a bottom and a sidewall, the bottom being affixed to the base plate; and one or more interposed unaffixed cylindrical rings each having sidewalls, wherein in a first expanded state the sidewalls of adjacent rings form frictional seals and the speaker driver, the base plate and the one or more interposed unaffixed cylindrical rings form a substantially airtight rigid chamber having a height substantially equal to the sum of the sidewall heights of the cylindrical rings, and in an unexpanded state the sidewalls of the cylindrical rings are substantially parallel to one another.

2. The portable speaker unit of claim 1 wherein the first cylindrical ring sidewall has a first height, the second cylindrical ring sidewall has a second height approximately equal to the first height, and each interposed unaffixed cylindrical ring has a height approximately equal to the first height.

3. The portable speaker unit of claim 1 further comprising a lid having at least one arc for receiving the speaker unit and directing sound.

4. The portable speaker unit of claim 3 wherein the lid includes two arcs for receiving the speaker unit horizontally and directing sound.

5. The portable speaker unit of claim 4 wherein the base plate includes at least one flat portion.

6. The portable speaker unit of claim 3 wherein the lid is attached to the speaker unit by a hinge.

7. The portable speaker unit of claim 1 further comprising a damping pad attached to the base plate to receive the speaker driver when the portable speaker unit is in an unexpanded state.

8. The portable speaker unit of claim 1 wherein the base plate includes a filter.

9. The portable speaker unit of claim 8 wherein the filter is a passive radiator.

10. The portable speaker unit of claim 8 wherein the filter is a tuned port that allows bass energy to escape the enclosure.

11. The portable speaker unit of claim 1 wherein the top of the first affixed cylindrical ring is affixed to a flange and the flange is connected to the speaker driver.

12. A portable speaker unit comprising:

a speaker driver;

a first cylindrical ring, the first cylindrical ring having a top and a sidewall, the top being affixed to the speaker driver;

a base plate configured in parallel with the speaker driver;

a second cylindrical ring, the second cylindrical ring having a bottom and a sidewall, the bottom being affixed to the base plate;

one or more interposed unaffixed cylindrical rings each having sidewalls; and a lid enclosure, wherein in a first expanded state the sidewalls of adjacent rings form frictional seals and the speaker driver, the base plate and the one or more interposed unaffixed cylindrical rings form a substantially airtight rigid chamber having a height substantially equal to the sum of the sidewall heights of the cylindrical rings, and in an unexpanded state the sidewalls of the cylindrical rings are substantially parallel to one another, and the lid is placed over the speaker and in contact with the base plate to completely enclose said portable speaker unit.

13. The portable speaker unit of claim 12 wherein the lid includes two arcs for directing the speaker unit across a range of horizontal angles.

14. The portable speaker unit of claim 12 wherein the base plate is circular and includes at least one flat portion.

15. The portable speaker unit of claim 12 wherein the base plate includes a filter.

16. The portable speaker unit of claim 12 wherein the base plate includes a housing with a retractable cord spooling assembly that allows a speaker cord to be automatically retracted during transport.

17. A portable audio system including a portable speaker unit comprising:

a class-D amplifier;

a speaker driver receiving an audio signal from the class-D amplifier;

a first cylindrical ring, the first cylindrical ring having a top and a sidewall, the top being coupled to the speaker driver;

a base plate configured in parallel with the speaker driver;

a second cylindrical ring, the second cylindrical ring having a bottom and a sidewall, the bottom being affixed to the base plate; and one or more interposed unaffixed cylindrical rings each having sidewalls;

wherein in a first expanded state the sidewalls of adjacent rings form frictional seals and the speaker driver, the base plate and the one or more interposed unaffixed cylindrical rings form a substantially airtight rigid chamber having a height substantially equal to the sum of the sidewall heights of the cylindrical rings, and in an unexpanded state the sidewalls of the cylindrical rings are substantially parallel to one another.

18. The portable audio system of claim 17 wherein the base plate includes a housing with a retractable cord spooling assembly that allows a speaker cord to be automatically retracted during transport.

19. The portable speaker unit of claim 17 further comprising a lid having two arcs for receiving the speaker unit horizontally and directing sound.

20. The portable speaker unit of claim 17 wherein the base plate is circular and includes at least one flat portion.

* * * * *